US005460063A

United States Patent [19]

Hodgson

[11] Patent Number: 5,460,063

[45] Date of Patent: Oct. 24, 1995

[54] COMBINATION HAND TOOL

[76] Inventor: Donald E. Hodgson, 9081 Tahoe La., Boulder, Colo. 80301

[21] Appl. No.: 277,995

[22] Filed: Jul. 20, 1994

[51] Int. Cl.[6] ..... B25B 13/28

[52] U.S. Cl. ..... 81/90.2; 81/437; 81/439

[58] Field of Search ..... 81/90.2, 53.2, 81/437–439

[56] References Cited

U.S. PATENT DOCUMENTS 2,592,037 4/1952 Keiser ..... 81/90.2 X 4,676,125 6/1987 Ardelean ..... 81/90.2 X 4,724,730 2/1988 Mader et al. ..... 81/90.2 X

*Primary Examiner*—James G. Smith

[57] ABSTRACT

A combined screwdriver and nut driver wherein multi-bit screwdriver is on one end and an adjustable nutdriver on the other end for easy transportation.

3 Claims, 3 Drawing Sheets

COMBINATION HAND TOOL

FIELD OF THE INVENTION

This invention is directed to tools normally used for assembly, disassembly, remove, tighten, replace screws, nuts bolts or similar types of activity. More specifically the invention is directed to a combination tool, whereby a plurality of tools are combined for easy packing and transporting as a single unit for independent use when desired.

BACKGROUND OF THE INVENTION

In normal repair activities, such as auto repair, home repair, bike assembly or the like, it is desirable to have different tools available for different purposes. Two of the more commonly used tools in such activities are the nutdriver and a multi bit screwdriver. There have been no suggestions in prior art to combine these tools into a single unit.

BRIEF SUMMARY OF THE INVENTION

This invention relates to a combination tool which is the preferred embodiment comprises an adjustable nutdriver on one end and a multibit screwdriver on the other.

Hexagonal shank insert bits or adaptors are positioned in cavities in the handle of the tool for ready transportation, therewith but may be readily and completely removed from and replaced into the handle. This is accomplished by having a light press fit on the insert bits or adaptor. There can be as many of the cavities as needed for different sizes and shapes. On the other end thereof an adjustable nutdriver having three independent jaws, in which the jaws may be adjusted to engage a wide range of nuts or bolts.

These and other objects of the invention will be apparent from the following more particular description of the preferred embodiment as illustrated in the accompanying drawings in which like reference characters refer to same parts throughout the various views. The drawings are not necessarily to scale, emphasis instead being placed upon illustrating the principles of the invention.

DETAILED DESCRIPTION OF THE INVENTION

Figure 1:
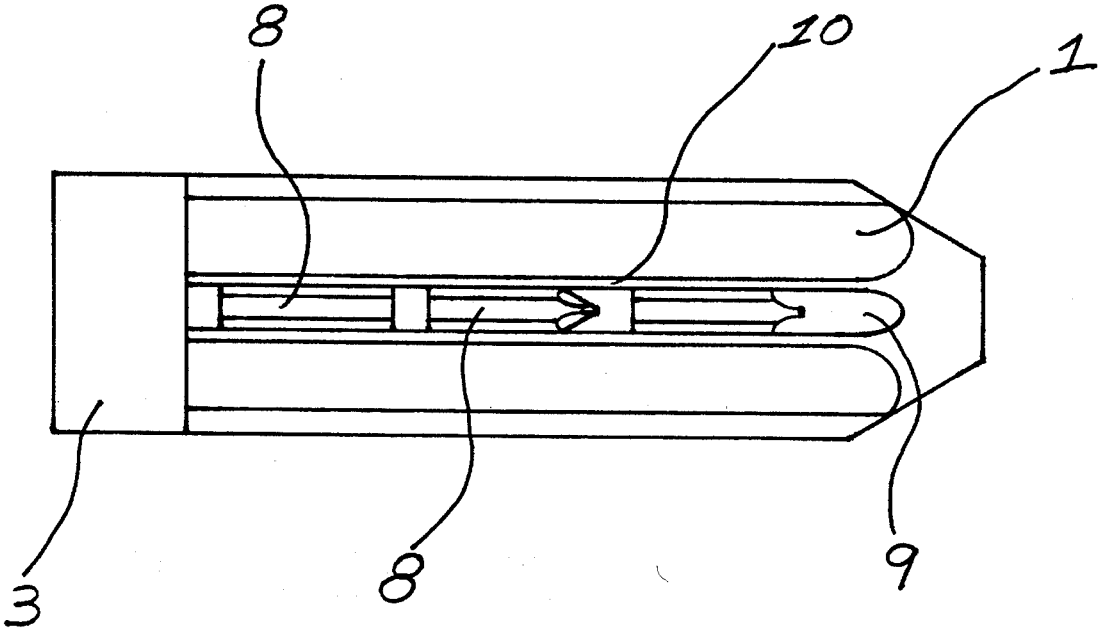
FIG. 1 is a side elevation of the invention.
Figure 2:
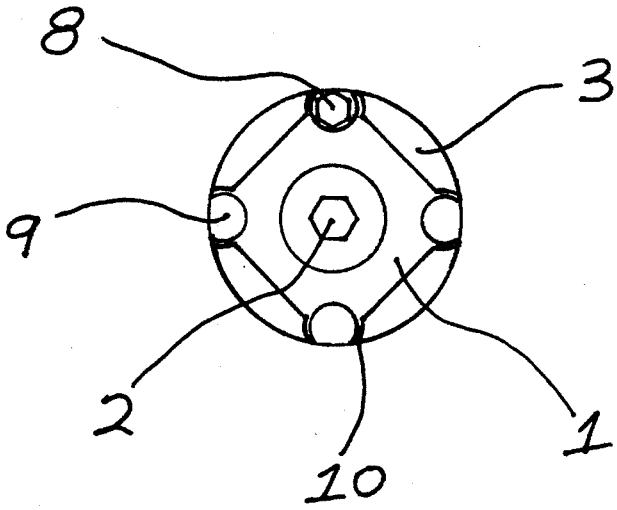
FIG. 2 is an end view of FIG. 1.

In FIGS. 1 and 2 there is illustrated a combination tool having a handle, (1) At one end of the handle, a hexagonal cavity, (2) for inserting the screwdriver insert bits (8)) The handle (1) is provided with cavities (9)) defined by the walls (10) partially surrounding and allowing passage of insert bits (8). On the other end cap(3) secured to handle (1) by means of a flange (12) allowing cap (3) to rotate but cannot be completely removed from the handle (1). Mounted under cap (3), jaws (6) are positioned in handle (1) by means of shank (7).

Figure 3:
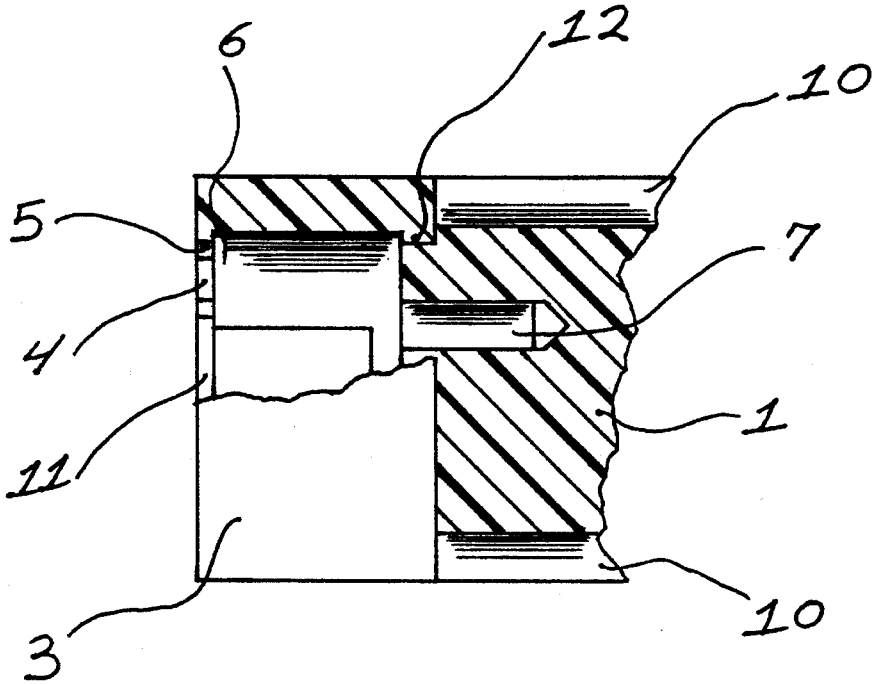
FIG. 3 is a plan view of one jaw with a portion of the handle and cap in cross section.
Figure 4:
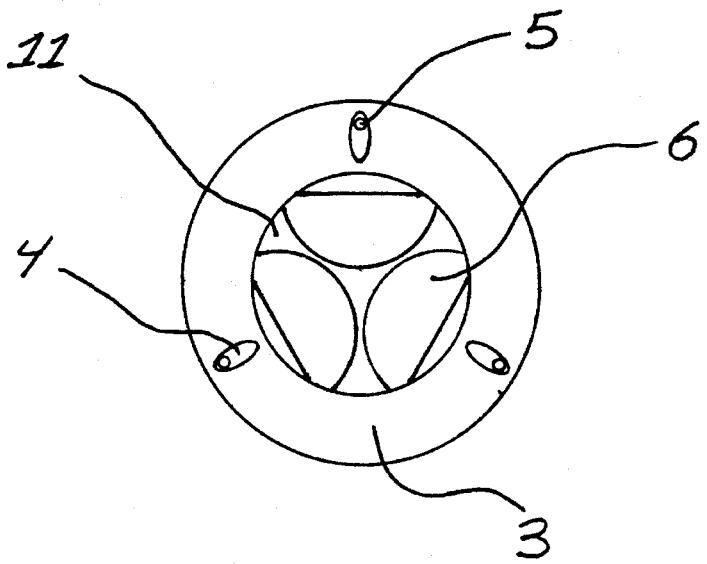
FIG. 4 is an enlarged end view of cap illustrating adjustable nutdriver portion of the invention with the jaws fully open.
Figure 5:
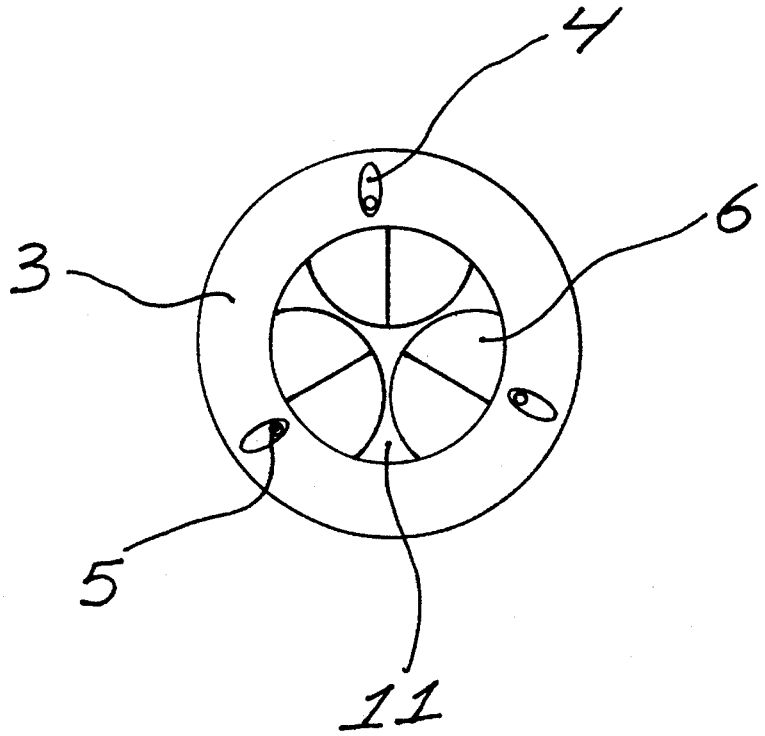
FIG. 5 is an enlarged end view of cap illustrating the adjustable nut driver portion of the invention with the jaws fully closed.
Figure 6:
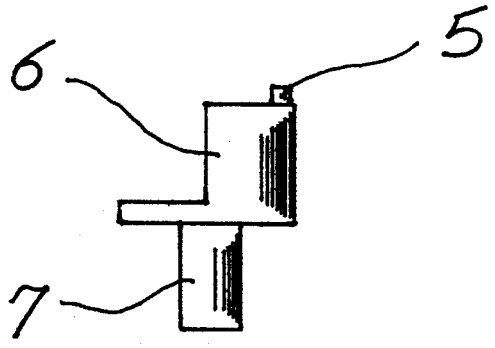
FIG. 6 is an enlarged side elevation of one jaw.

The adjustable nutdiver is illustrated in FIGS. 3, 4, and 5 comprises a cap (3),three pivoting slots (4),three pivot pins (5) and three jaws (6). When cap (3) is rotated left or right pivot pins (5) are driven back and forth in pivot slots (4) opening and closing jaws (6). Cutout (1i) allows nut or bolts to enter into and clamped by jaws (6). In FIG. 6 there is illustrated a jaw (6) comprising a pivot pin (5) and shank (7). While the preferred embodiments of the invention have been described herein, it may be otherwise embodied and practiced within the scope of the following claims.

What is claimed is:

1. A tool comprising a handle having two opposite ends, one of said ends having an aperture, a series of screwdriver bits mountable in said aperture, a plurality of jaws pivotally mounted on the other of said ends, a ring rotatably secured to the other end of said handle for securing said jaws between said ring and said other end of said handle such that, wherein said ring is pivotal attached to each of said jaws in such a manner so that upon rotation of said jaws are pivoted to adjust the spacing between each said jaws.

2. A tool according to claim 1 further comprising storage means on said handle to accommodate said series of screwdriver bits.

3. A tool according to claim 2 wherein said aperture is of the same shape as said screwdriver bits to provide a non-rotating connection between said bits and said aperture.

* * * * *